US008776770B2

(12) United States Patent
Batdorf

(10) Patent No.: US 8,776,770 B2
(45) Date of Patent: Jul. 15, 2014

(54) BOW WITH ADJUSTABLE LIMBS

(75) Inventor: Richard Batdorf, Dunlap, TN (US)

(73) Assignee: Archery America, L.L.C., DeQuincy, LA (US)

( * ) Notice: Subject to any disclaimer, the term of this patent is extended or adjusted under 35 U.S.C. 154(b) by 298 days.

(21) Appl. No.: 13/189,001

(22) Filed: Jul. 22, 2011

(65) Prior Publication Data

US 2012/0192843 A1 Aug. 2, 2012

Related U.S. Application Data

(60) Provisional application No. 61/366,669, filed on Jul. 22, 2010.

(51) Int. Cl.
*F41B 5/00* (2006.01)
*F41B 5/14* (2006.01)
*F41B 5/10* (2006.01)

(52) U.S. Cl.
CPC .... *F41B 5/10* (2013.01); *F41B 5/14* (2013.01)
USPC ..... 124/23.1; 124/25.6; 124/86; 124/88

(58) Field of Classification Search
CPC ..... F41B 5/14
USPC ..... 124/23.1, 25.6, 86, 88
See application file for complete search history.

(56) References Cited

U.S. PATENT DOCUMENTS 5,280,779 A * 1/1994 Smith ..... 124/88
5,339,790 A * 8/1994 Smith ..... 124/25.6
5,464,001 A * 11/1995 Peck ..... 124/25.6
5,487,373 A * 1/1996 Smith ..... 124/23.1
5,507,270 A * 4/1996 Smith ..... 124/23.1
5,515,836 A * 5/1996 Martin et al. ..... 124/23.1
5,660,158 A * 8/1997 Rudolph ..... 124/23.1
5,697,355 A * 12/1997 Schaffer ..... 124/25.6
5,697,358 A * 12/1997 Campisi ..... 124/88
6,024,076 A * 2/2000 Laborde et al. ..... 124/23.1
6,244,259 B1 * 6/2001 Adkins ..... 124/23.1
6,712,057 B2 * 3/2004 Andrews ..... 124/23.1
6,886,549 B2 * 5/2005 McPherson ..... 124/23.1
7,025,051 B1 * 4/2006 Gallops, Jr. ..... 124/23.1
7,165,543 B2 * 1/2007 Simo et al. ..... 124/44.5
7,334,575 B2 * 2/2008 McPherson ..... 124/23.1
7,337,773 B2 * 3/2008 Simo et al. ..... 124/44.5
7,373,934 B2 * 5/2008 Smith et al. ..... 124/25.6
7,699,045 B1 * 4/2010 Kronengold et al. ..... 124/25.6
7,762,245 B2 * 7/2010 Smith et al. ..... 124/25.6
7,784,452 B1 * 8/2010 Kronengold et al. ..... 124/23.1
7,832,387 B1 * 11/2010 Yehle ..... 124/25.6
7,832,388 B1 * 11/2010 Kronengold et al. ..... 124/25.6
7,918,218 B1 * 4/2011 Kronengold et al. ..... 124/23.1
7,980,236 B1 * 7/2011 Kronengold et al. ..... 124/25.6

(Continued)

OTHER PUBLICATIONS

Special Hyperlite Pocket Notice, Precision Shooting Equipment, Inc. Feb. 10, 2006.

*Primary Examiner* — Gene Kim
*Assistant Examiner* — Alexander Niconovich
(74) *Attorney, Agent, or Firm* — Schultz & Associates, P.C.

(57) ABSTRACT

Archery bow adjustment systems that enable adjustment of both the draw weight and the brace height of the bow. The adjustment system includes a plate mounted on an end of a riser of the bow. The plate supports a limb of the bow and is adjustably positionable relative to the riser.

7 Claims, 16 Drawing Sheets

(56) References Cited

U.S. PATENT DOCUMENTS

| | | | | |
|---|---|---|---|---|
| 8,047,189 | B2 * | 11/2011 | McPherson | 124/23.1 |
| 8,079,353 | B2 * | 12/2011 | Davis et al. | 124/23.1 |
| 8,347,869 | B2 * | 1/2013 | Sims et al. | 124/23.1 |
| 8,408,192 | B2 * | 4/2013 | McPherson | 124/23.1 |
| 8,453,635 | B1 * | 6/2013 | McPherson | 124/86 |
| 8,459,244 | B2 * | 6/2013 | Yehle | 124/25.6 |
| 2003/0084893 | A1 * | 5/2003 | Andrews | 124/23.1 |
| 2005/0121012 | A1 * | 6/2005 | McPherson | 124/23.1 |
| 2009/0145411 | A1 * | 6/2009 | Sims et al. | 124/25.6 |

* cited by examiner

BOW WITH ADJUSTABLE LIMBS

CROSS-REFERENCE TO RELATED APPLICATION

This application claims priority to U.S. Provisional Application Ser. No. 61/366,669 filed Jul. 22, 2010, and entitled BOW WITH ADJUSTABLE LIMBS, incorporated by reference herein in its entirety.

FIELD

The present disclosure relates to the field of archery bows. More particularly, the disclosure relates to adjustable limb pockets for bows that enables one or more of the limbs of the bow to slide with respect to the riser to enable adjustment of both the draw weight and brace height of the bow.

BACKGROUND

Archery bows of all types include a pair of curved elastic limbs connected by a bow string. As the bow is drawn by pulling back on the string, energy is stored in the limbs. When the string is released, the string is propelled rapidly forward and energy is transferred via the string to an arrow to be projected by the bow. Compound bows use a lever system having cables and pulleys to bend the limbs. Compound bows typically have a stiff central riser made of aluminum or the like and a pair of rigid yet elastic limbs made of a composite material and mounted to limb pockets at opposite ends of the riser. Each limb is typically solid or split to have a base and two limb portions extending from the base. The riser has a central grip that is grasped by the user with an adjacent arrow rest which supports a shaft portion of the arrow.

Archers seek an archery bow that will achieve consistent accuracy. In addition to being accurate, an archery bow should also be adjustable with respect to the bow poundage and brace height. The brace height of a bow is the distance from the string to a low or pivot point of the grip grasped by the archer when the string is at the rest position and not pulled back. Shortening the brace height increases the bow poundage or draw weight, which is the force required to fully draw the string and corresponds to the energy stored by the limbs that will be transferred to the arrow upon release of the string. Bows with shorter brace heights are typically faster, having more draw weight, but are less forgiving to shoot. Bows with longer brace heights will generally shoot slower, with less energy transferred, but will be more forgiving to errors of form or technique of the user. Accordingly, it is desirable to enable an archer to easily adjust the brace height, and hence poundage, to better configure a bow to suit a particular archer.

Various attempts have been made to provide a limb pocket that will allow for adjustment of the draw weight of the bow, but do so without changing the brace height. For example, a conventional structure utilizes a pivot design that allows the limbs to pivot with respect to the riser. In the pivot design, a limb bolt is tightened or loosened to provide for adjustment of the draw weight, but without changing the brace height. The use of a pivot is also disadvantageous in that it creates inaccuracies when the limb bolt is backed out to reduce the draw weight of the bow. Accordingly, what is desired is an improved bow structure that enables adjustment of the draw weight and the brace height of the bow while avoiding shortcomings of prior adjustment structures.

Improvement is also desired in the provision of bow limbs.

Accordingly, the present disclosure relates to adjustable limb pocket systems that allow one or more of the limbs to slide with respect to the riser, providing adjustment of both the draw weight and brace height of the bow. The disclosure also relates to improved bow limbs, and to adjustable limb pocket systems for use with the same.

SUMMARY

The above and other needs are met, in one aspect, by an archery bow, including a riser having a pair of opposed ends, a limb pocket system mounted to each end of the riser, a limb mounted on each limb pocket systems and a bow string connected to the limbs.

Each limb pocket system includes a plate or other mechanism adjustably positionable relative to the end of the riser in a direction that is substantially aligned with a front to back axis of the end of the riser so as to enable adjustment of both the draw weight and brace height of the bow.

The limb pocket system advantageously enables adjustment of draw weight and brace height using adjustable limb pockets which are configured to move the position of the limb relative to the riser. The structure is also advantageously configured to allow for adjustment of the draw weight and brace height while the bow is in tension.

In another aspect, the disclosure relates to an archery bow including a riser having a pair of opposed ends, a limb pocket system mounted to each end of the riser, a limb mounted on each limb pocket system and a bow string connected to the limbs. Each limb is cylindrical or tubular.

The provision of bow limbs configured as cylinders or tubes enables improved performance and strength characteristics, with aesthetic features and reduced weight savings as compared to conventional limb construction.

The disclosure also describes limb pocket systems configured for use with the cylindrical or tubular limbs, enabling even further advantages.

Another aspect of the disclosure relates to a bow including a riser having a pair of opposed ends, a limb pocket system mounted to each end of the riser, a limb mounted on each limb pocket systems and a bow string connected to the limbs. Each limb pocket system includes a plate and a turnbuckle. The plate has a proximal end pivotally mounted onto a first portion of the riser and an opposite distal end pivotally connected to a first end of the turnbuckle, with a second end of the turnbuckle being pivotally mounted to a second portion of the riser at location spaced from the first portion of the riser.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
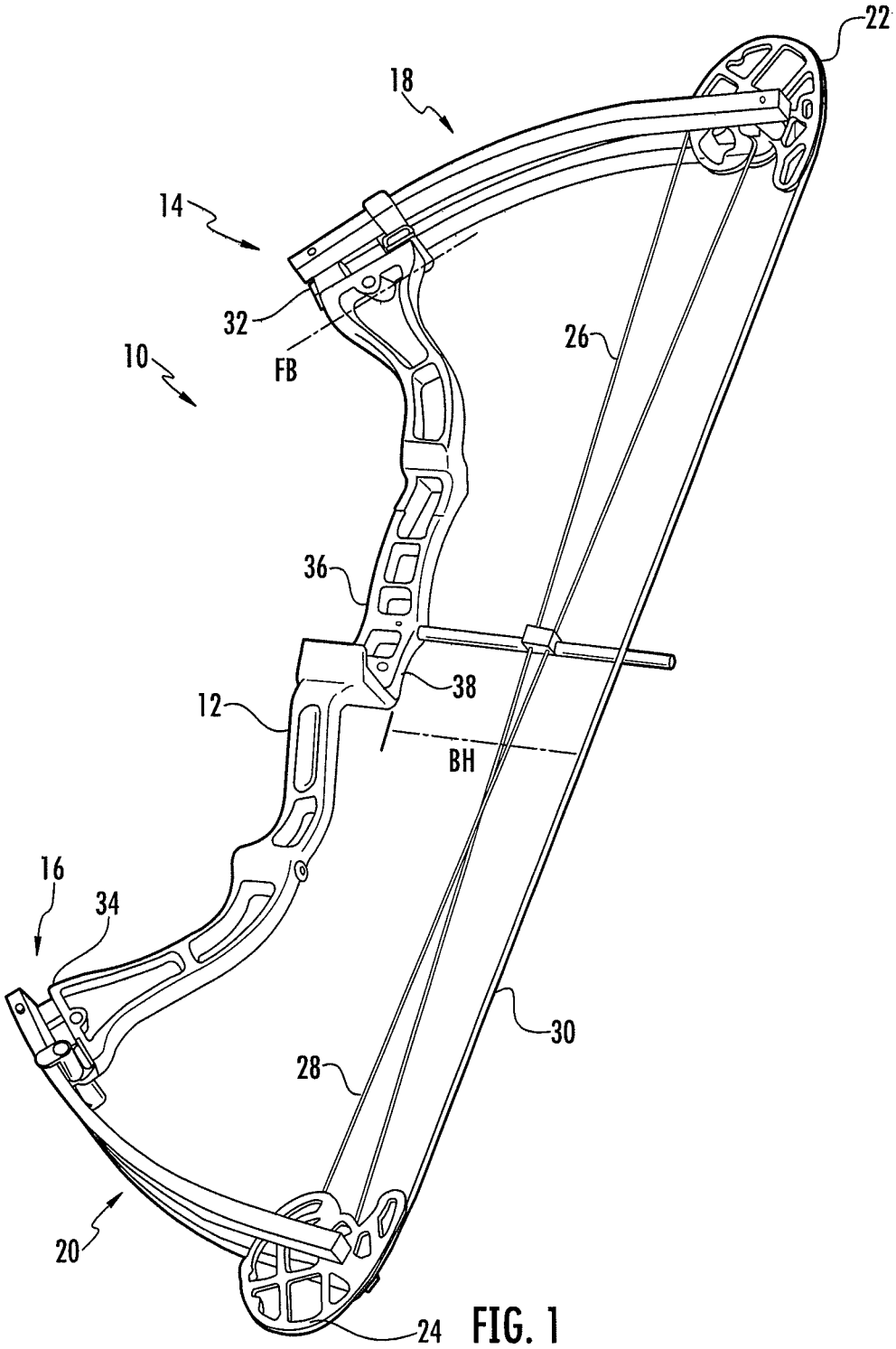
FIG. 1 is a perspective view of a bow having split limbs and an adjustable limb pocket system to enable adjustment of the brace height and the draw weight of the bow according to one embodiment of the disclosure.
Figure 2:
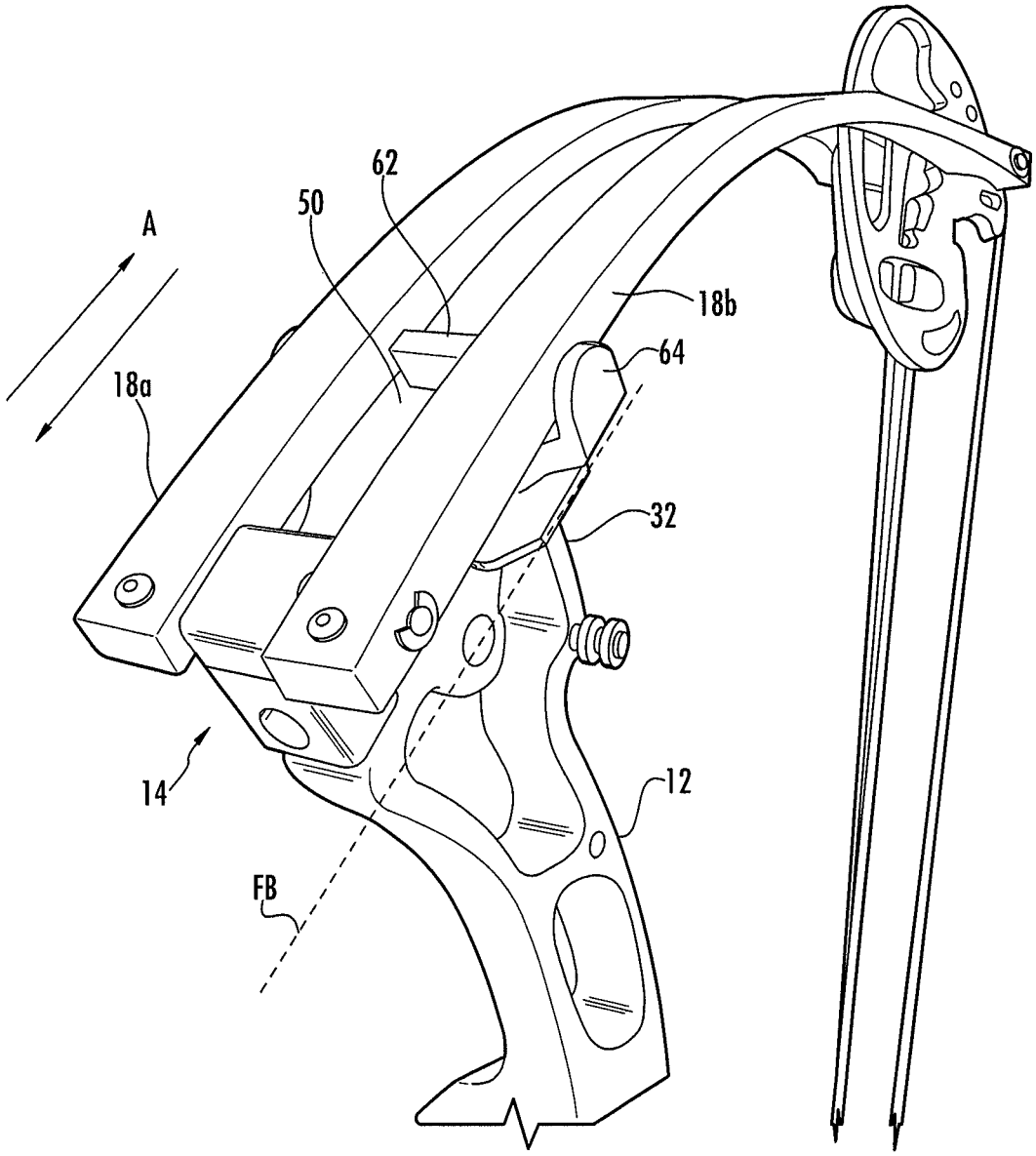
FIG. 2 is a close-up perspective view of an adjustable sliding limb pocket of the bow of FIG. 1.
Figure 3:
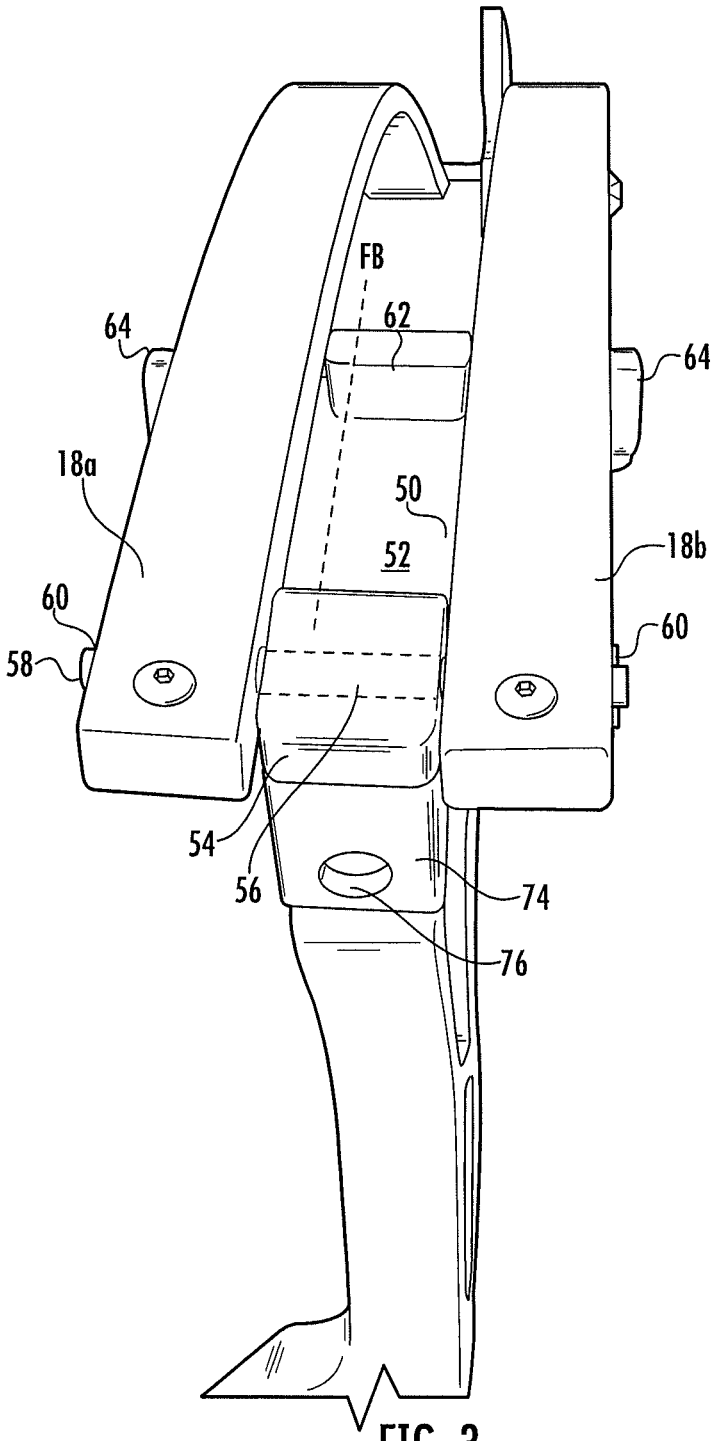
FIG. 3 is a front view of the adjustable sliding limb pocket shown in FIG. 2.
Figure 4:
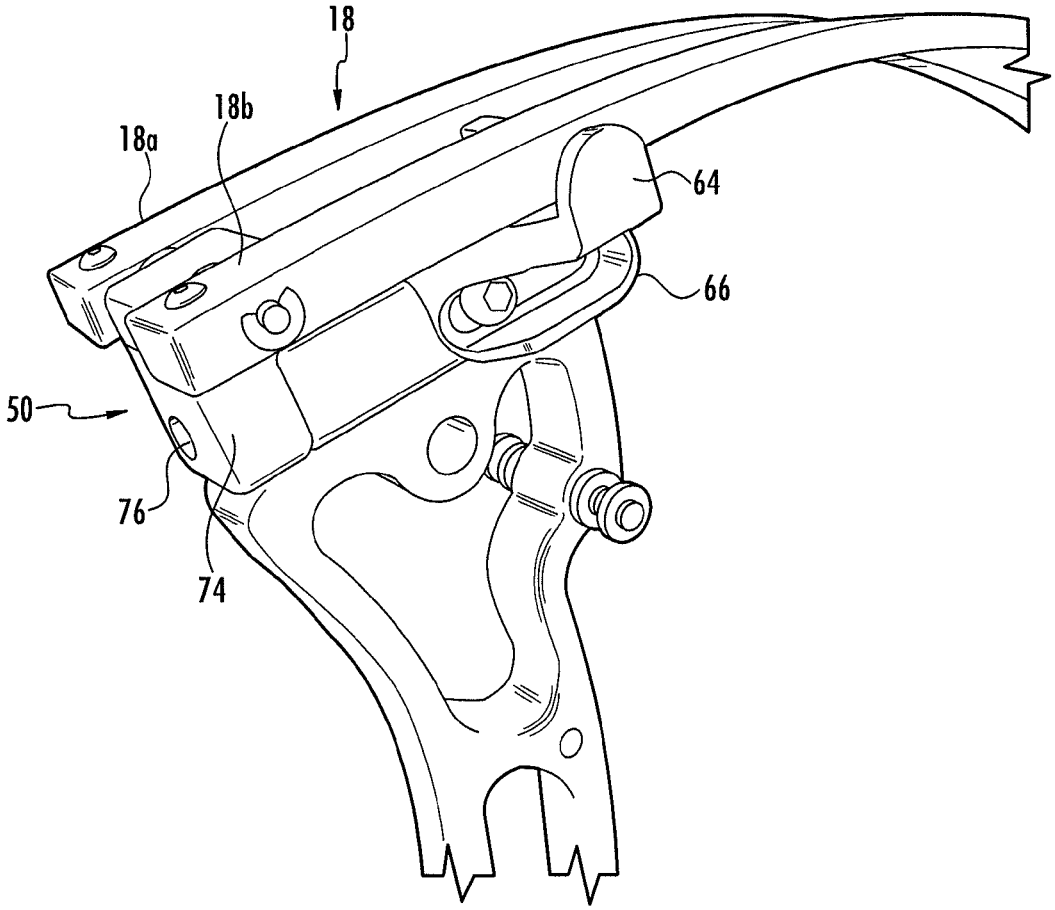
FIG. 4 is a left side of the adjustable sliding limb pocket shown in FIG. 2.

The disclosure relates to archery bows configured to enable adjustable positioning of limbs of the bow in a manner that enables adjustment of the draw weight of the bow and the brace height of the bow.

With initial reference to FIGS. 1-12, the disclosure relates to in one embodiment to an archery bow 10 configured as a compound bow and having a riser 12, a pair of limb pocket systems 14 and 16 mounted on the riser 12, a pair of limbs 18 and 20 mounted on the limb pocket systems 14 and 16, a pair of pulleys or cams 22 and 24 rotatably attached to the limbs 18 and 20, a pair of cam cables 26 and 28 connected to the limbs 18 and 20 via the cams 22 and 24, and a bow string 30 connected to the cams 22 and 24.

While the limb pocket systems 14 and 16 are described in connection with a compound bow structure, it will be understood that they may also be used in connection with other bow structures, such as a longbow or recurve bow, and enable adjustable positioning of the limbs in a manner that enables adjustment of the distance of the bow string from the riser known as the brace height, as explained more fully below. Also, FIG. 1 and FIGS. 2-5 show the limb 14 being a split limb having a pair of limb sections 18*a* and 18*b*. It will be understood that the limb 18 may also be configured as a single member and not split, such as shown in FIG. 6.

The riser 12 is an elongate, preferably one piece member, of durable and rigid construction, and made of rigid composite resinous materials, rigid plastics, metals, or the like, preferably including various cutouts for reduced weight. The riser includes a pair of opposed ends 32 and 34, intermediate of which is defined a grip 36 having a low or pivot point 38.

The bow string 30 is shown at rest or substantially untensioned in FIG. 1, it being understood that the bow 10 is operable by placing an arrow substantially perpendicular to the length axis of the riser 12 such that a shaft of the arrow rests on a bow rest adjacent the grip 36 and a notched end of the arrow is received by the bow string 30. When the bow string 30 is drawn back, the cams 22 and 24 rotate oppositely (one counter-clockwise and the other clockwise). The rotating cams 22 and 24 pull on the cables 26 and 28, which bends the limbs 18 and 20 to store energy.

The limb pocket systems 14 and 16 advantageously enable desired adjustment of the position of the limbs 14 and 16 relative to the riser 12 to enable selective and precise adjustment of a brace height BH of the bow 10 as well as the draw weight of the bow. The brace height BH is the distance from the string 30 to the pivot point 38 of the grip 36 of the riser 12 when the string 30 is at the rest position and not pulled back. The draw weight is the force required to fully draw the bow string 30.

The ends 32 and 34 of the riser 12 are substantially identical to one another and configured to mountably receive and support the limb pocket systems 14 and 16, respectively. Accordingly, for the sake of brevity, only the end 32 and the limb pocket 14 are described herein, it being understood that the end 34 and limb pocket system 16 are substantially identical thereto.

Figure 5:
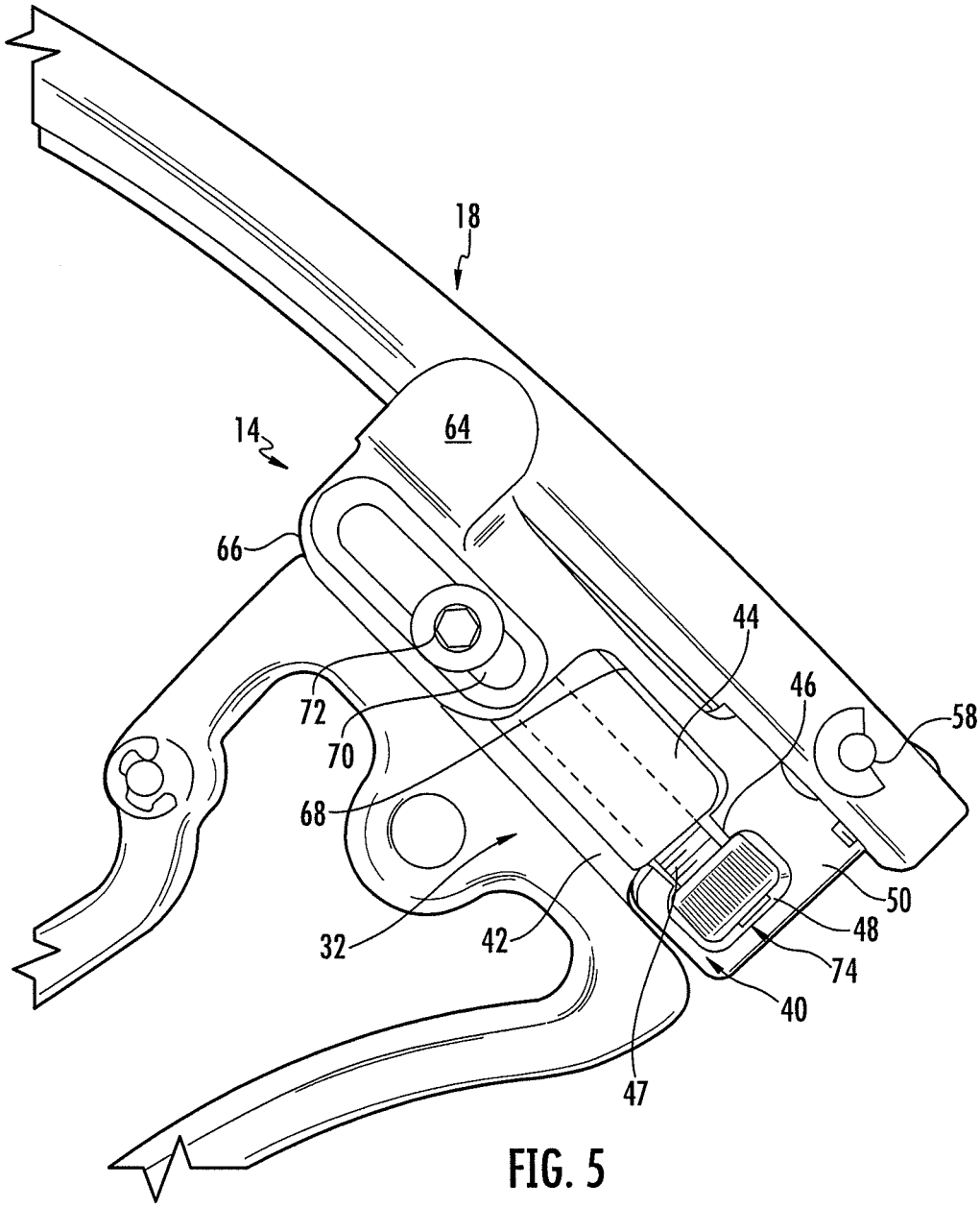
FIG. 5 is a right side view of the sliding limb pocket of FIG. 2.
Figure 6:
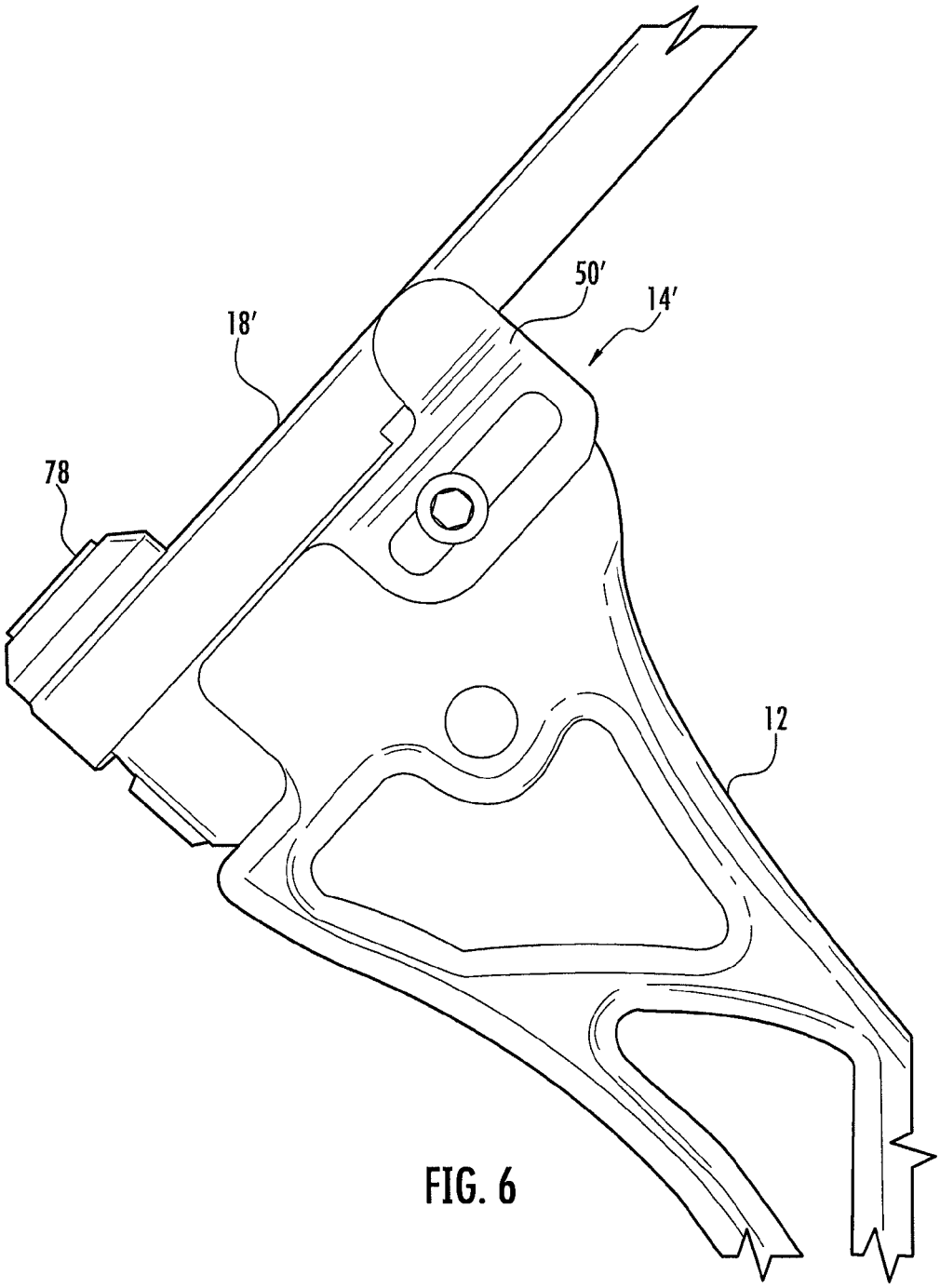
FIG. 6 shows a sliding limb pocket according to the disclosure in use with a solid limb.

With reference to FIGS. 2-5, and especially FIG. 5, in one embodiment, the end 32 is generally rectangular, having substantially the same width as the riser 12, but not extending the full front to back span of the riser 12 so as to define a notch 40 at a frontal portion of the end 32. A pair of elongate parallel grooves 42 are defined on opposite sides of the end 32 and along the length of the end 32 below the notch 40. A threaded bore 44 extends into the end 32 adjacent the notch 40 parallel to the front to back span of the end 32 for cooperating with a threaded fastener, such as bolt 46, of the limb pocket system 14. The bolt 46 has a threaded shaft 47 threadably received by the bore 44 so that a head 48 of the bolt 46 may be adjusted either toward or away from the face of the bore 44 by threading the boll 46 into the bore 44 or unthreading the bolt 46 from the bore 44.

Figure 7:
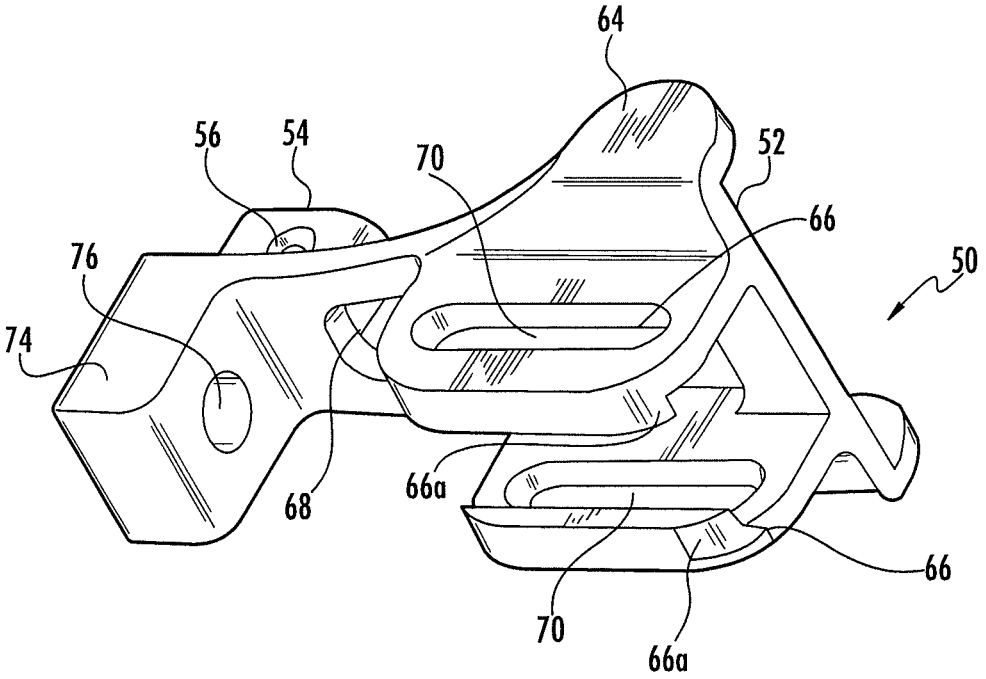
FIG. 7 shows a traveling member of the adjustable limb pocket systems of the bow of FIG. 1.

With additional reference to FIG. 7, the limb pocket system 14 includes a pocket plate 50 configured to be mounted onto the end 32 of the riser 12 so as to be adjustably positonable relative to the riser 12, and to mountably receive the limb 18. The pocket plate 50 includes a pocket surface 52 located to face opposite the end 32 when the pocket plate 50 is mounted onto the end 32. The pocket surface 52 is configured to mountably receive the limb 18. In this regard, the pocket surface 52 includes a central raised plateau 54 adjacent a front edge thereof for spanning between the limb sections 18*a* and 18*b* in the case of the limb 18 being a split limb to maintain the desired spacing of the limbs 18*a* and 18*b*. A bore 56 extends across the width of the plateau 54 for receiving a pin 58. The pin 58 also extends through bores defined across the widths of the limbs sections 18*a* and 18*b* and is secured in place as by snap rings 60 to enable the limb sections 18*a* and 18*b* to be secured to the plateau 54 of the pocket surface 52.

A central raised plateau 62 is located adjacent a rear edge of the pocket surface 52 from spanning between the limb sections 18*a* and 18*b*. Sidewalls 64 are located to be spaced apart and rise from opposite side edges of the pocket surface 52, with the limb sections 18*a* and 18*b* received there between. A pair of guides 66 extend from a surface 68 of the pocket plate 50 opposite the pocket surface 52. The guides 66 are aligned with the front to back length of the plate 50 and are spaced so as to align on opposite sides of the end 32 and to closely receive the end 32 there between. The guides 66 preferably include a rail 66*a* along an interior edge thereof for traveling within the grooves 42 of the end 32. The guides 66 each include an elongate slotted aperture 70 therethrough for receiving on of a pair of guide pins 72 located on opposite sides of the end 32 for cooperating with the apertures 70. The guide pins 72 may be provided as by fasteners threadably installed into threaded bores defined on the end 32 perpendicular to the bore 44. The pins 72 may be loosened to permit adjustments and tightened once adjustments are made, as described more fully below. In various alternate embodiments, locking mechanisms other than guide pins may be used to hold the limbs in position relative to the riser.

To enable the pocket plate 50 to be movably adjustable relative to the end 32 when the bolt 46 is threaded into or out of the bore 44. the pocket plate 50 further includes a bolt head receptacle 74 located to be positioned in front of the notch 40 of the frontal portion of the end 32. The receptacle 74 is configured to engage the head 48 of the bolt 46 while enabling the threaded shaft 47 of the bolt 46 to extend into the threaded bore 44, such that the receptacle 74, and hence the pocket plate 50, travels with the head 48 of the bolt 46. The head 48 of the bolt 46 may be rotated as by use of an alien wrench or other driver compatible with and insertable to the head 48 via an access aperture 76. It will be appreciated that other structure may be utilized to permit adjustment of the plate 50 in the in the directions of the arrows A (FIG. 2) corresponding to a direction that is substantially aligned with a front to back axis FB of the end 32 of the riser 12. For example, a worm gear structure may be incorporated to cooperate between the pocket plate 50 and the end 32.

The use of a threaded adjustment member, such as a worm gear or bolt enables substantially continuous adjustment, as compared to incremental adjustment that only permits adjustment to a few predetermined positions. However, structure for enabling incremental adjustment along the front to back axis FB of the end 32 of the riser 12 may also be utilized. For example, a slidable or otherwise movable traveler associated with the plate 50 may be utilized, with the traveler having a ball and detent type interface with the end 32. In this manner, set adjustment points, each with a desired brace height or draw weight may be defined. Likewise, the bow 10 may be calibrated and indicia included with the pocket systems to permit easy selection of a desired draw weight or brace height.

With reference to FIG. 6, a limb pocket system 14' may be provided for attachment of a single limb 18' using a limb bolt 78. In this regard, the limb pocket system 14' is substantially similar to the limb pocket system 14, except a plate 50' thereof does not include any structure corresponding to the plateaus 54 or 62 of the plate 50. The limb bolt 78 passes through an aperture of the limb 18' and into a threaded aperture in the plate 50' to secure the limb 18' to the plate 50', with the plate 50 being adjustably positionable relative to the end 32 of the riser 12 in the manner of the plate 50.

When in use, the bow is oriented such that the riser 12 is furthest from the archer while the bow string 30 is closest to the archer. When the archer is firing, the bow string 30 is pulled toward the archer creating greater tension in the limbs 18 and 20. To decrease the draw weight of the bow, the limb pocket system 14 and the limb pocket system 16 may be adjusted by first loosening the guide pins 66 and/or other locking mechanisms. Next, the bolt 46 of each limb pocket is backed out, causing the plate 50 thereof to move away from the archer and the cams 22 and 24 to rotate, decreasing the distance between the cams 22 and 24. In addition to decreasing the draw weight, movement of the limbs 18 and 20 toward the riser 12 will decrease the brace height of the bow, decreasing the distance between the bow string 30 and the pivot point 38 of the riser 12. When the boll 46 of each limb pocket system 14 and 16 is tightened, the limb pockets slide towards the archer, causing the cams to rotate in an opposite manner, increasing the draw weight of the bow and increasing the brace height. After adjustments have been made, the guide pins 72 are lightened to lock the desired position. Adjustment of the bow as described is quickly accomplished and does not require removal of the bow string 30, or otherwise any detensioning of the bow string 30.

Accordingly, it will be appreciated that the structure of the system 10 enables adjustment of draw weight and brace height using adjustable limb pockets which are configured to slidably move the position of the limb relative to the riser. The structure is also advantageously configured to allow for adjustment of the draw weight and brace height while the bow is in tension.

With reference now to FIGS. 8-12, there is shown another embodiment of a limb pocket system 100 configured to enable adjustment of draw weight and brace height. And also configured to include novel limbs 102 and 104 of cylindrical or tubular construction.

Figure 8:
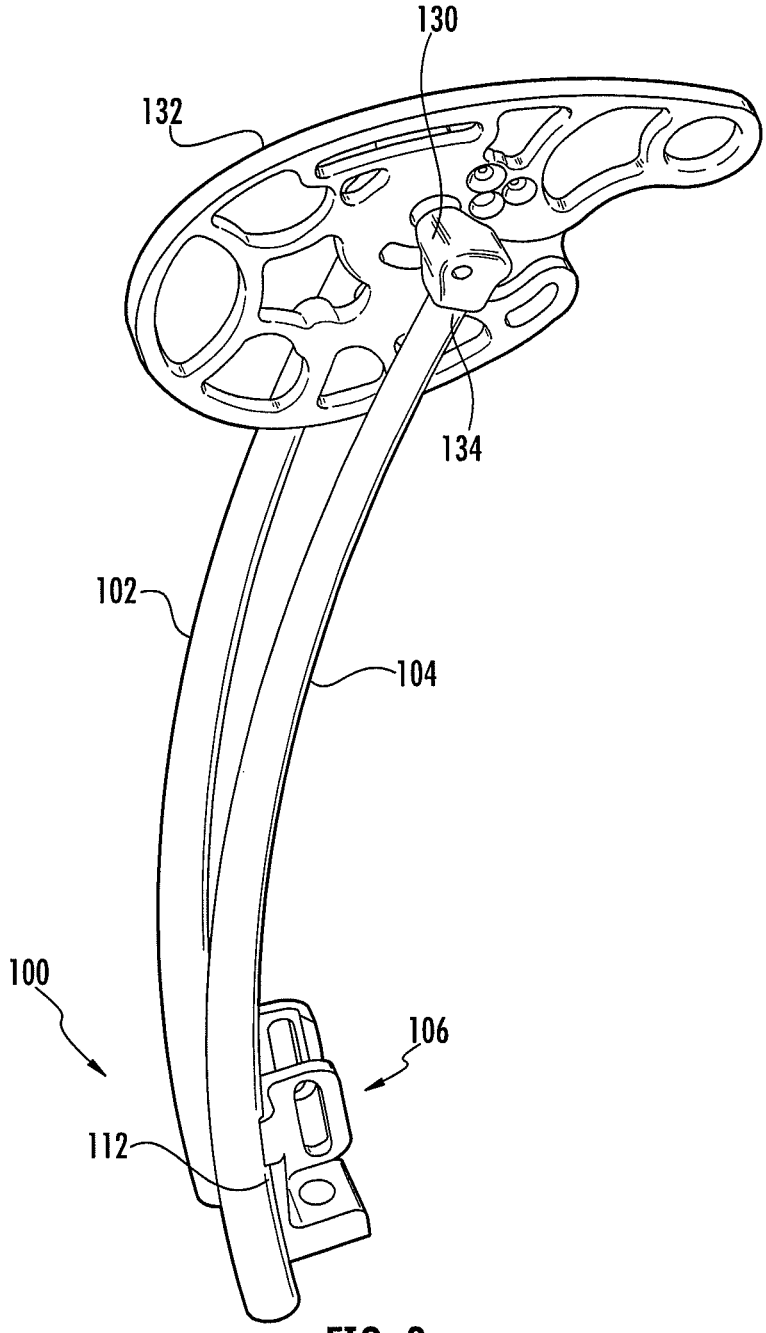
FIGS. 8 and 9 show an alternate embodiment of an adjustable limb pocket system according to the disclosure, featuring cylindrical limbs.
Figure 9:
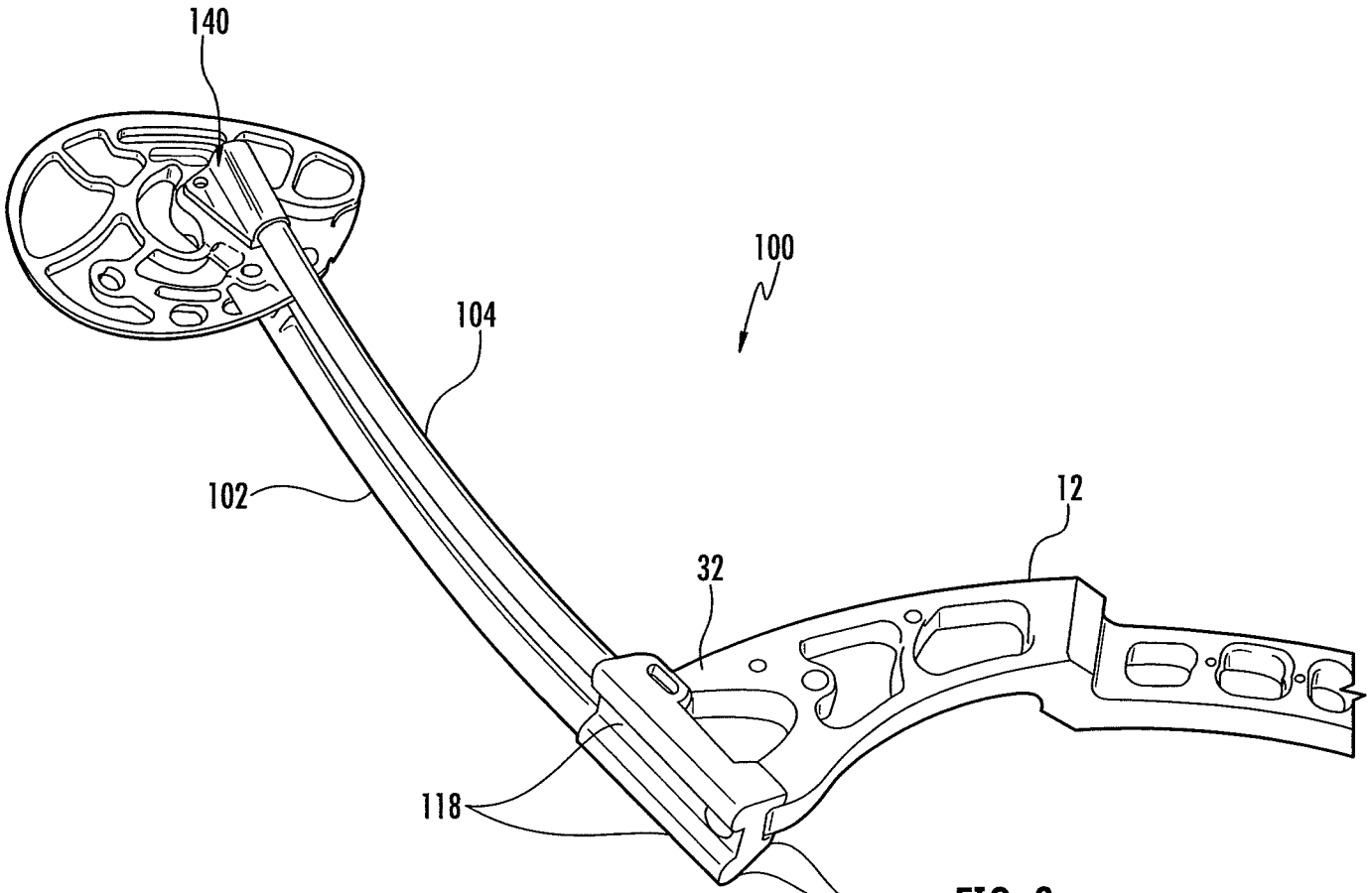

While the limb pocket system 100 is described in connection with a compound bow structure, it will be understood that they may also be used in connection with other bow structures, such as a longbow or recurve bow, and enabling a stronger limb design through the use of a cylindrical shaped limb. Also, while FIGS. 8 and 9 show the limb system 100 being used with a pair of limbs 102 and 104, it wilt be understood that the bow could have only a single one of the cylindrical limbs 102 and 104 and that the limb system 100 could be configured to mount a single limb.

The limb pocket system 100 includes a pocket plate 106 configured to mountably receive the cylindrical limbs 102 and 104. The plate 106 is substantially identical to the plate 50 described above, except the portions thereof that mount to the limbs of the bow are configured for use with the cylindrical limbs 102 and 104. Accordingly, the plate 106 includes mourning and adjustment features in the manner of the plate 50, to enable it to be mounted to the end 32 of the bow and to permit adjustment of the position of the limb relative to the riser 12 in the manner previously described.

The pocket plate 106 includes a pocket surface 112 configured to mountably receive the cylindrical limbs 102 and 104. In this regard, the pocket surface 112 may include a pair of curved elongate surfaces, one for receiving each of the limbs 102 and 104, to maintain the desired lateral spacing of the limbs 102 and 104. FIG. 9 shows the pocket surface having a pair of fully enclosed lubes 118, each configured to mountably receive one of the cylindrical limbs 102 and 104. The enclosed lubes 118 have an interior diameter equivalent to the exterior diameter of the cylindrical limbs 102 and 104 to maintain the desired alignment and spacing of the limbs 102 and 104. One end 119 of the enclosed tube 118 is solid to act as a barrier and prevent the limbs 102 and 104 from passing completely through the enclosed tube 118. The limbs 102 and 104 are secured to the enclosed tubes 118 as by the use of a fastener, epoxy, or the like.

Figure 10:
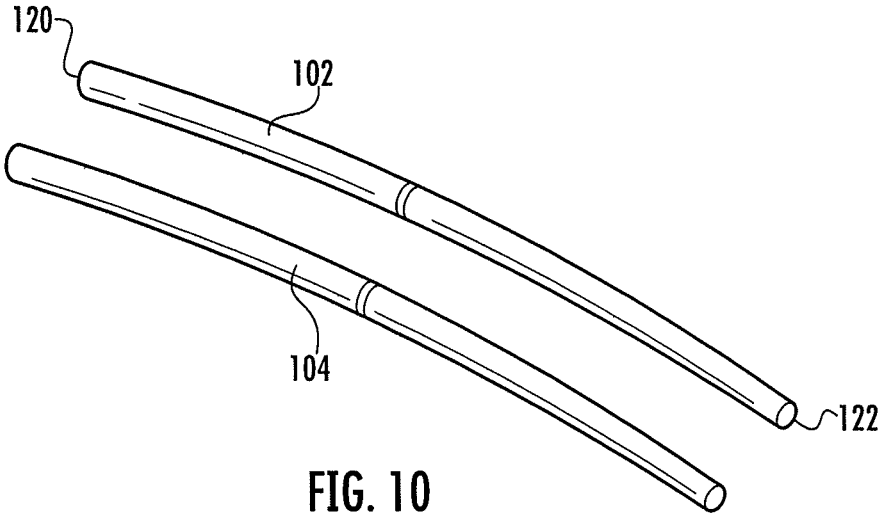
FIG. 10 is a perspective view of the cylindrical limbs of the system of FIGS. 8 and 9.

The limbs 102 and 104 are substantially identical to one another. Accordingly, only limb 102 will be discussed. With reference to FIG. 10, the cylindrical limb 102 is constructed of a stiff composite material enabling the limb 102 to flex without compromising the integrity of the limb 102. The limb 102 may be constructed such that an end 120 thereof which is connected to the pocket plate 106 has a diameter greater than the diameter of an opposite end 120 located furthest from the pocket plate 106, with the limb 102 having a tapered shape from the larger diameter end 120 to the smaller diameter end 122. It will also be understood that end 120 may be of an equivalent or lesser diameter than end 122. The cylindrical limb 102 may be tubular in construction or solid. In this regard, the limb 102 configured as a tube has a hollowed out interior which may result in the limb 102 having a substantially decreased weight as compared to a solid version. In addition, the thickness of the wall of a tubular construction of the limb 102 may be varied to produce differing characteristics of the limb 102 when flexing under tension.

Figure 11:
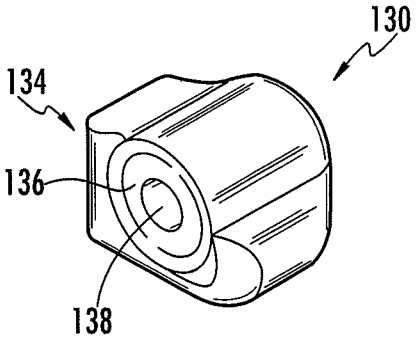
FIGS. 11 and 12 show a limb cap component of the system of FIGS. 8 and 9.
Figure 12:
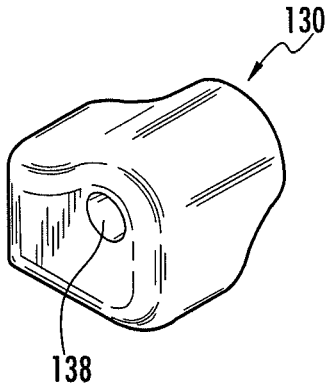
Figure 13:
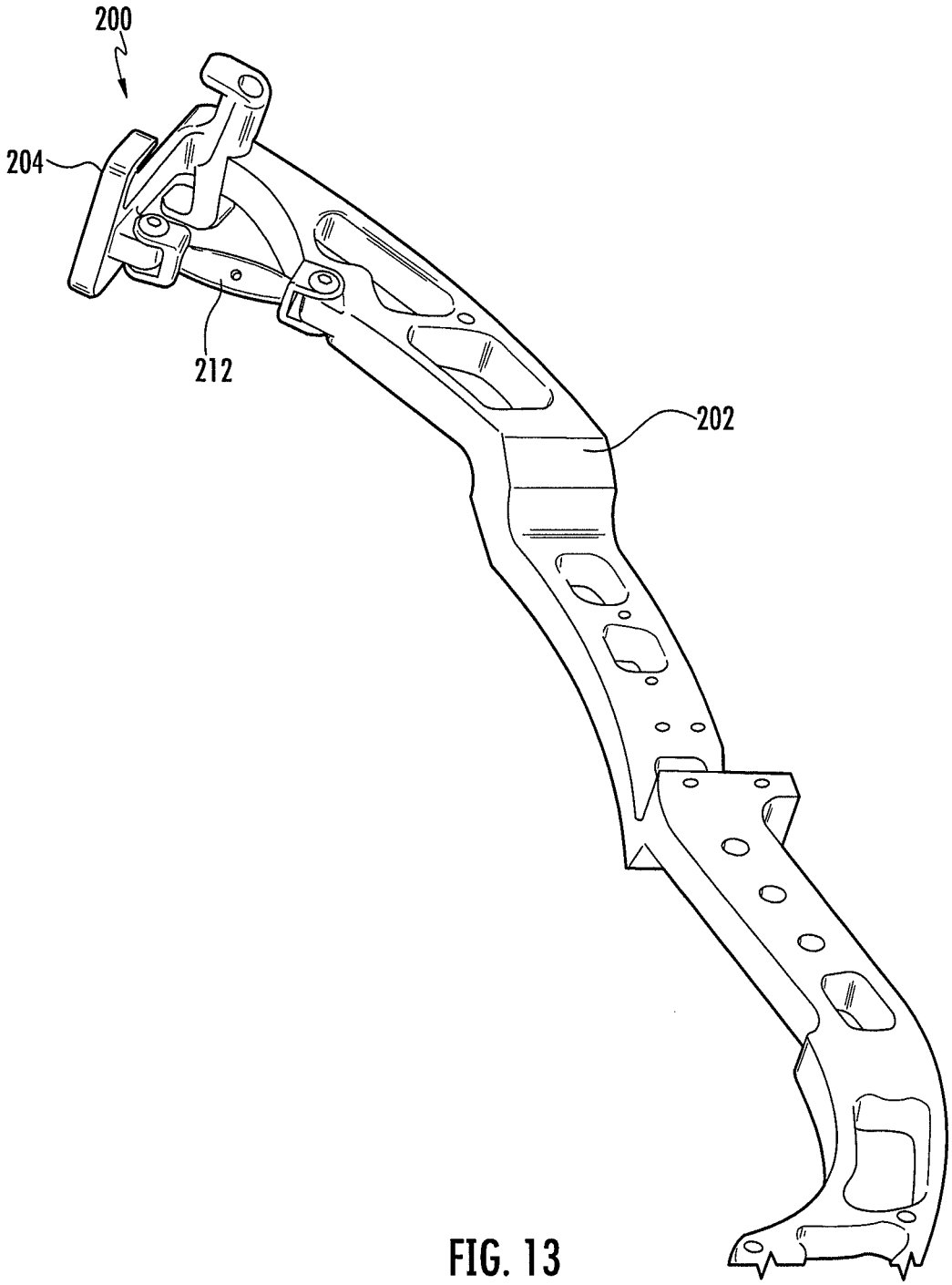
FIGS. 13-18 show yet another alternate embodiment of an adjustable limb pocket system according to the disclosure.
Figure 14:
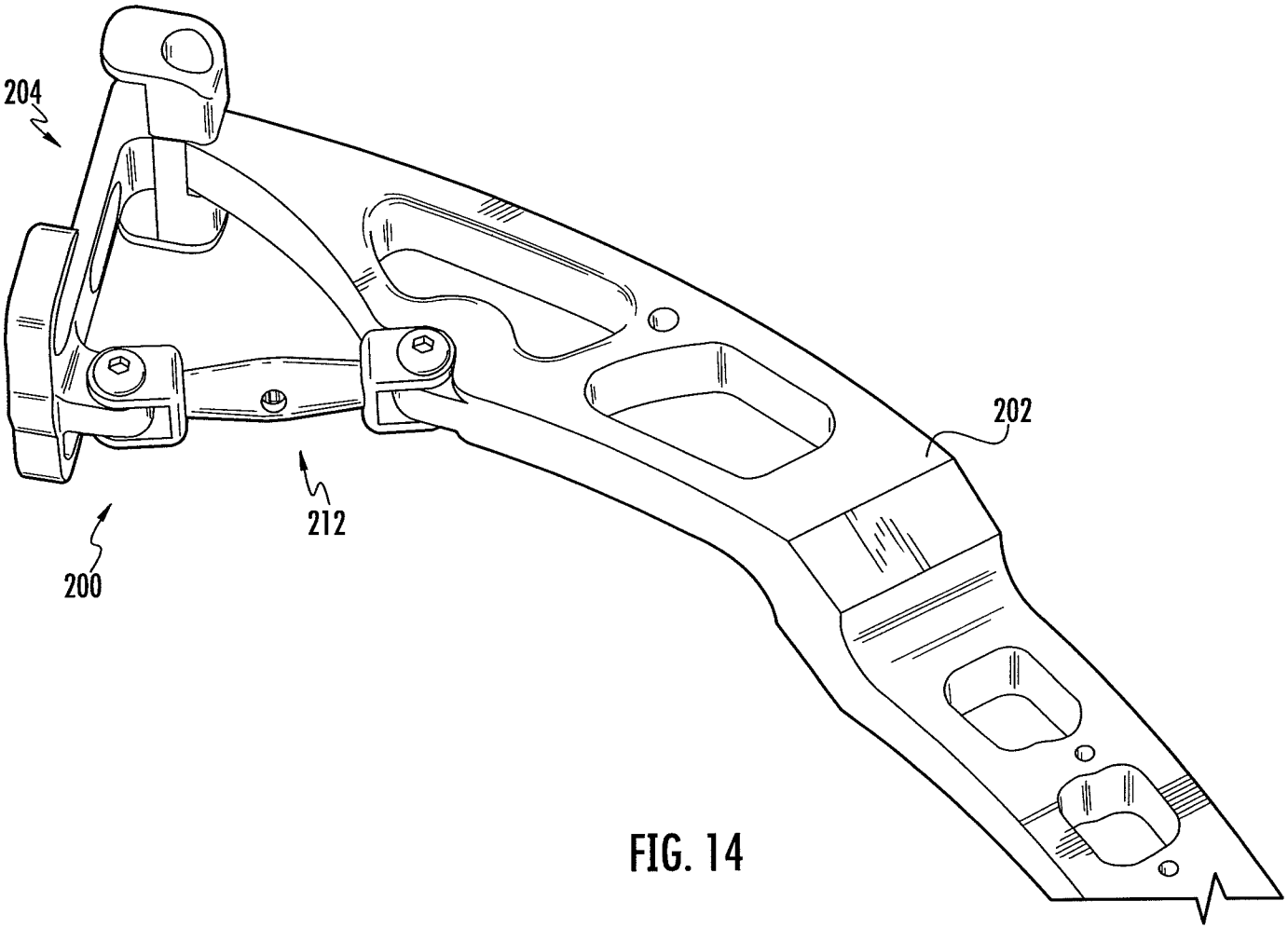
Figure 15:
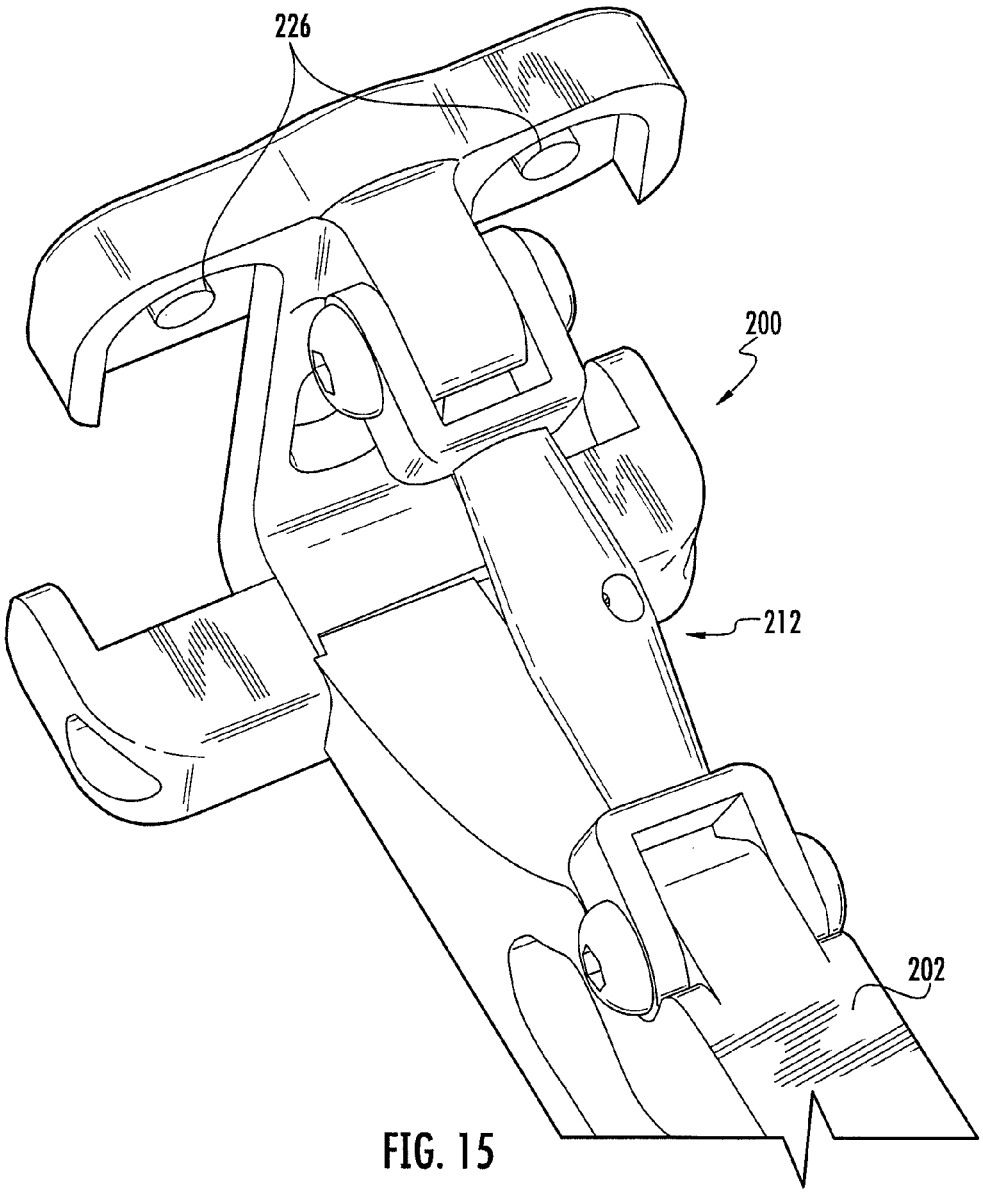
Figure 16:
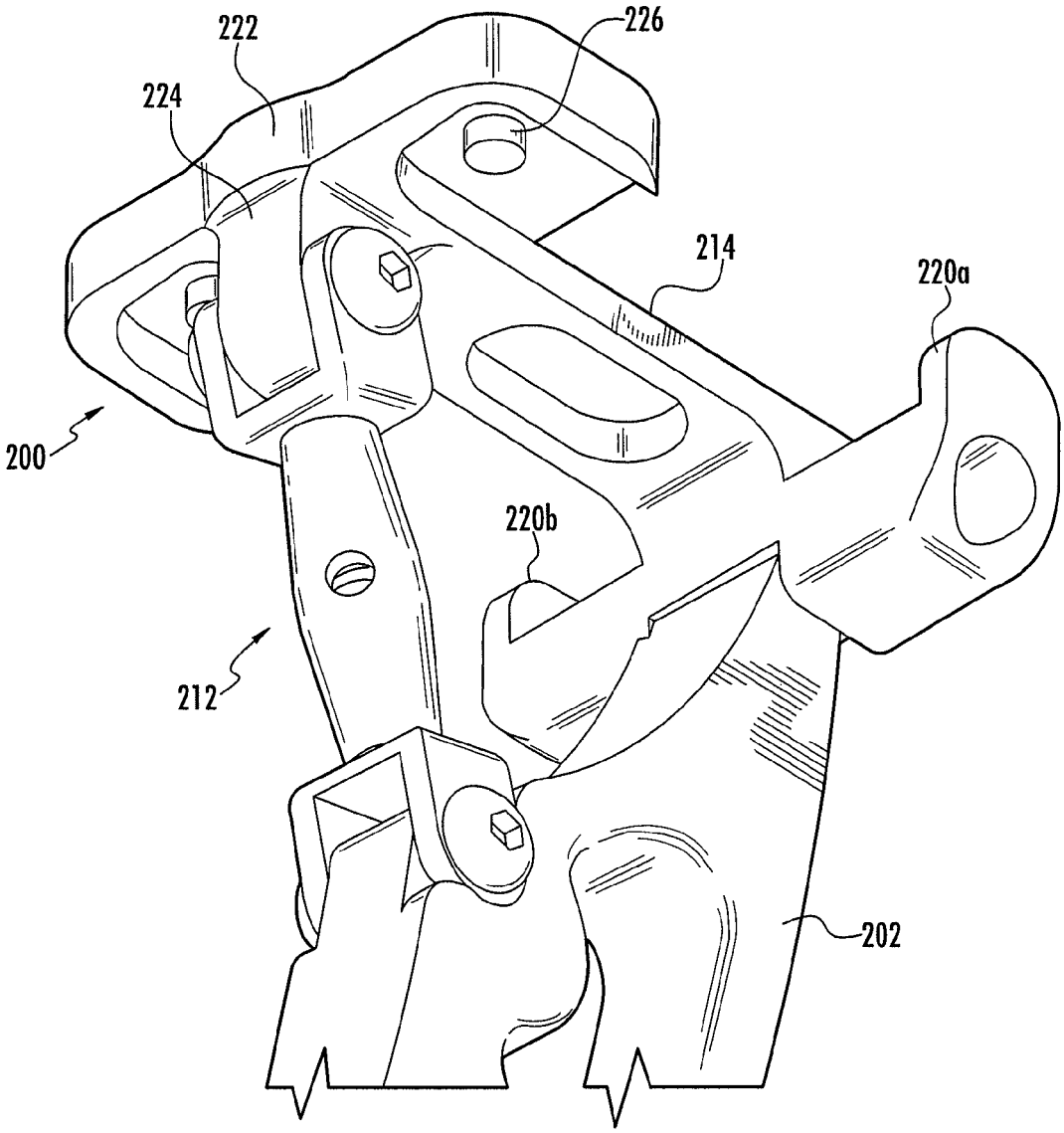
Figure 17:
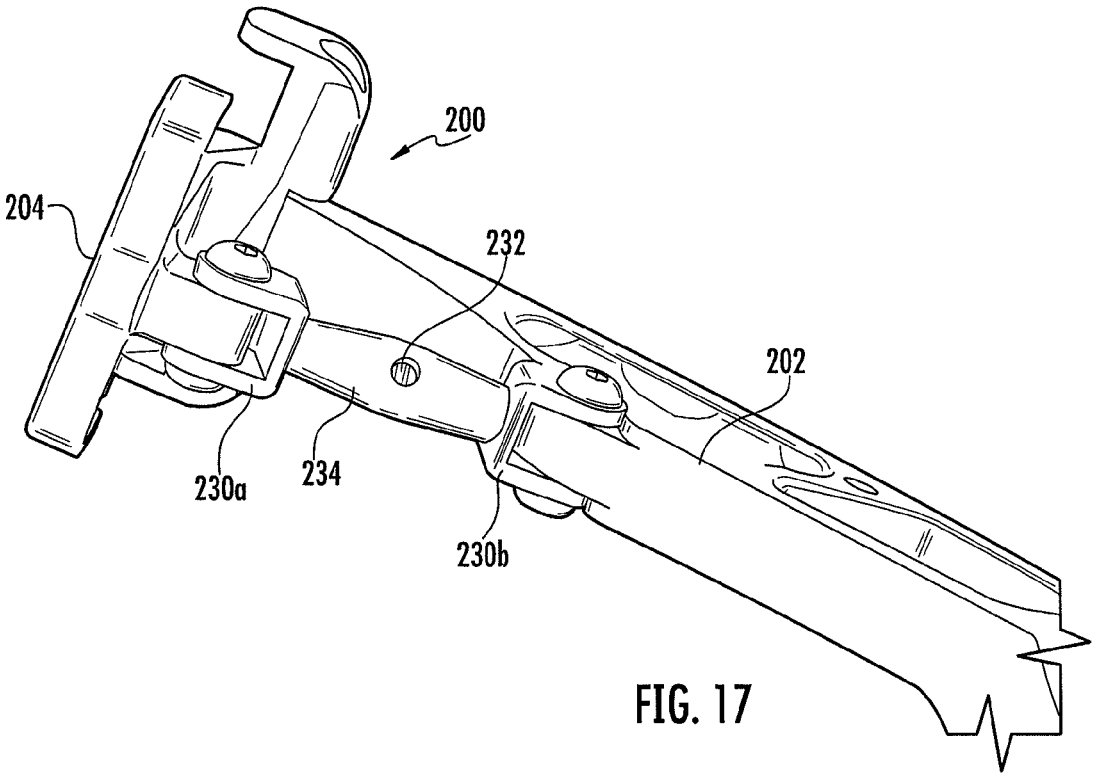
Figure 18:
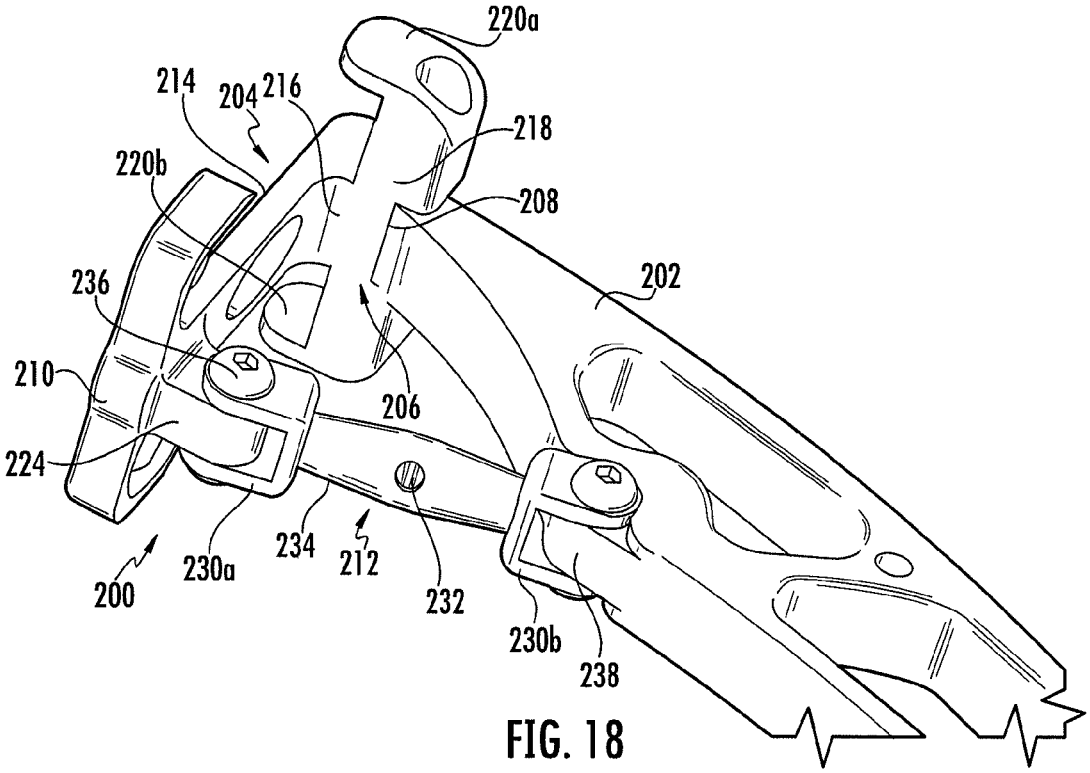

With additional reference to FIGS. 11 and 12, a limb cap 130 is installed on the end 122 of the limb 102 (and the limb 104) for rotatably mounting a cam 132 to the limbs 102 and 104 of the bow configuration of FIG. 8. In this regard, a bore 134 extends into the limb cap 130 to allow the limb 102 to fit within the limb cap 130. It is also understood that with the use of a tubular limb 102, the limb cap may be mountably attached by fitting to the interior of the tubular limb 102 thereby spreading the force over the interior surface of the tubular limb. An aperture 136 extends through the limb cap 130 perpendicular to the bore 132 for mountably receiving a cam axle 138 of the cam 132 to enable mounting of the cam 110 without the requirement of drilling an aperture through the limb 102. The bow of FIG. 9 also utilizes a limb cap 140 to connect to the limbs and permit mounting of a cam. The limb cap 140 is configured to have a limb receiving sleeve and a cam mount surface extending from the sleeve.

It is believed that the limbs 102 and 104 configured as cylinders or tubes enables improved performance and strength characteristics, with aesthetic features and reduced weight savings as compared to conventional limb construction.

With reference now to FIGS. 13-18, there is shown an alternate embodiment of a limb pocket system 200 mounted onto a riser 202 of a bow. As will be appreciated, the bow may include a pair of the limb pocket systems 200 in the manner of the limb pocket systems 14, 16 and 100. The system 200 may be used with bow structures such as the ones discussed herein to enable desired adjustment of the position of the limbs relative to the riser to enable selective and precise adjustment of the brace height of the bow and the draw weight of the bow.

The limb pocket system 200 includes a generally I-shaped pocket plate 204 (when viewed from above) having a proximal end 206 configured to be pivotally mounted onto a terminal end 208 of the riser 202 and an opposite distal end 210 configured to be pivotally connected to a turnbuckle 212 pivotally mounted to the riser 202 at location on the riser 202 spaced from the terminal end 208. A central member 214 extends between and spaces apart the proximal end 206 and the distal end 210 of the pocket plate 204. The central member 214 may include portions thereof removed for an aesthetic appearance and to reduce weight.

The proximal end 206 of the pocket plate 204 is generally T-shaped having a central post 216 and a crosspiece 218. To help maintain the bow limbs (in the case of a split limb) in place on opposite sides of the post 214, sidewalls 220*a* and 220*b* extend parallel to the post 216 at the ends of the crosspiece 218. It will be understood that the proximal end 206 may be otherwise configured for receiving portions of a bow limb so as to be compatible with a variety of bow limb configurations. The proximal end 206 of the pocket plate 204 may be pivotally mounted to the riser 202 as by a fastener extending through aligned apertures provided through portions of the proximal end 206 of the pocket plate and the terminal end 208 of the riser 202.

The distal end 210 of the pocket plate 204 includes a cross-member 222 parallel to and elevated relative to the crosspiece 218 of the proximal end 206 and a depending centrally located turnbuckle mount 224. The surfaces of the cross-member 222 feeing toward the turnbuckle 212 includes projections 226 for engaging apertures on the bow limbs.

The turnbuckle 212 includes a pair of opposite yokes 230*a* and 230*b*, from which extend threaded shafts, indicated generally at 232, one shaft with a left-hand thread and the other with a right-hand thread. An internally threaded body 234 receives the threaded shafts of the yokes 230*a* and 230*b*, and the body 234 is rotated to cause both yokes 230*a* and 230*b* to be screwed in or out simultaneously, depending on the direction of rotation, without twisting thereof. The yoke 230*a* is pivotally mounted to the turnbuckle mount 224 as by a fastener 236. Likewise, the yoke 230*a* may be mounted to a turnbuckle mount 238 located on the riser 202. Accordingly, rotation of the body 234 may be accomplished to enable adjustable positioning of the limbs in a manner that enables adjustment of the brace height and/or draw weight.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed is:

1. An archery bow, comprising:
a riser having a pair of opposed ends, each end having a front to back axis, and a grip substantially intermediate the opposed ends and including a low point;
a limb pocket system mounted to each of the ends of the riser;
a limb mounted on each limb pocket system; and
a bow string extending between the limbs and movable between a rest position and a fully drawn back position,
wherein when the bow string is at the rest position it is spaced a distance from the low point of the grip to define a brace height of the bow and when the bow string is in the fully drawn back position by application of a force to fully draw the bow string to the fully drawn back position, the force required to fully draw the bow string defines a draw weight of the bow, and
wherein each limb pocket system comprises:
a plate adjustably movable relative to the end of the riser in a direction that is straight and parallel to the front to back axis of the end of the riser;
wherein adjustable positioning of the plate adjusts both the draw weight and brace height of the bow.

2. The bow of claim 1, wherein the limb pocket system includes a threaded fastener and the end of the riser includes a cooperating threaded bore for receiving the threaded fastener, whereby rotation of the fastener enables adjustment of both the brace height and the draw weight of the bow.

3. The bow of claim 1, wherein the limbs are mounted on the plate.

4. The bow of claim 1, further comprising a locking mechanism operable to hold the plate in position relative to the end of the riser.

5. An archery bow, comprising:
a riser having a pair of opposed ends and a grip substantially intermediate the opposed ends and including a low point;
a limb pocket system mounted to each of the ends of the riser;
a limb mounted on each limb pocket system;
a bow string extending between the limbs and movable between a rest position and a fully drawn back position;
wherein when the bow string is at the rest position it is spaced a distance from the low point of the grip to define a brace height of the bow; and,
wherein each limb pocket system comprises:
a plate having a proximal end pivotally connected to the riser, and a distal end; and,
a turnbuckle having a first set of threads and a second set of threads opposite in direction to the first set of threads, pivotally connected to the distal end and to the riser.

6. The bow of claim 5, wherein a portion of each limb is substantially cylindrical.

7. An archery bow, comprising:
a riser having a first opposed end having a first front to back axis and a second opposed end having a second front to back axis;

a first plate, adjustably connected to the first opposed end, moveable in a first direction straight and parallel to the first front to back axis;

a second plate, adjustably connected to the second opposed end, moveable in a second direction straight and parallel to the second front to back axis;

a first limb connected to the first plate; and, a second limb connected to the second plate.

* * * * *

UNITED STATES PATENT AND TRADEMARK OFFICE

CERTIFICATE OF CORRECTION

PATENT NO. : 8,776,770 B2
APPLICATION NO. : 13/189001
DATED : July 15, 2014
INVENTOR(S) : Richard Batdorf It is certified that error appears in the above-identified patent and that said Letters Patent is hereby corrected as shown below:

In the Specification:

| | |
|---|---|
| In Column 4, line 67 | change “alien” to --allen-- |
| In Column 6, line 7 | change “wilt” to --will-- |
| In Column 6, line 17 | change “mourning” to --mounting-- |
| In Column 6, line 27 | change “lubes” to --tubes-- |
| In Column 6, line 29 | change “lubes” to --tubes-- |

Signed and Sealed this
Seventeenth Day of March, 2015

Michelle K. Lee

Michelle K. Lee
*Director of the United States Patent and Trademark Office*